US006968811B2

(12) United States Patent
Rosenbaum

(10) Patent No.: US 6,968,811 B2
(45) Date of Patent: Nov. 29, 2005

(54) POWER TOOL HAVING A COMBUSTION CHAMBER AND METHOD OF COOLING THE COMBUSTION CHAMBER

(75) Inventor: Ulrich Rosenbaum, Wangs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/739,954

(22) Filed: Dec. 18, 2003

(65) Prior Publication Data

US 2004/0182331 A1 Sep. 23, 2004

(30) Foreign Application Priority Data

Dec. 19, 2002 (DE) ..... 102 59 773

(51) Int. Cl.[7] ..... F02F 1/10
(52) U.S. Cl. ..... 123/41.2; 123/46 H; 123/41.21
(58) Field of Search ..... 123/41.72, 46 H, 123/46 SC, 260, 41.2, 41.21

(56) References Cited

U.S. PATENT DOCUMENTS 2,134,662 A 10/1938 Flamm
3,863,612 A 2/1975 Wiener
4,062,266 A * 12/1977 Elmore et al. ..... 89/7
4,545,335 A 10/1985 Hayashi
4,782,795 A 11/1988 Kubozuka et al.
5,713,313 A * 2/1998 Berry ..... 123/46 SC
6,053,132 A 4/2000 Evans

FOREIGN PATENT DOCUMENTS

DE 9115865 6/1992
JP 5632026 4/1981

* cited by examiner

*Primary Examiner*—Andrew M. Dolinar
*Assistant Examiner*—Katrina Harris
(74) *Attorney, Agent, or Firm*—Abelman, Frayne & Schwab

(57) ABSTRACT

A power tool includes a combustion chamber (1; 54), a drive piston (8) adjoining the combustion chamber (1; 54) and displaceable upon combustion of fuel in the combustion chamber, an ignition device (52) for igniting the fuel in the combustion chamber (1; 54), and a cooling device (2*a*, 6*a*; 64; 70) connected with the combustion chamber (1; 54) for cooling the combustion chamber (1; 54) with a liquid cooling medium.

14 Claims, 4 Drawing Sheets

POWER TOOL HAVING A COMBUSTION CHAMBER AND METHOD OF COOLING THE COMBUSTION CHAMBER

BACKGROUND OF THE INVENTION

1. Field of the Invention

The present invention relates to a power tool, such as a combustion-engined tool or an explosion-operated tool, formed in particular as a settling tool for driving in fastening elements and including a combustion chamber, a drive piston adjoining the combustion chamber and displaceable upon combustion of fuel in the combustion chamber, and an ignition device for igniting the fuel in the combustion chamber. The present invention also related to a method of cooling the combustion chamber of the power tool.

2. Description of the Prior Art

In power tools described above, fuel in form of fuel gas mixture or in a powder form, e.g., stored in a cartridge, is fed into the combustion chamber of a power tool. The ignition of the fuel with an ignition device provides for driving of a piston which is displaced in a cylinder associated with the combustion chamber. A fastening element, which was fed in the headpiece of the power tool, can be, thus, driven by the piston, e.g., in a wall.

Power tools, in particular, bolt settings tools in which the piston rearward movement is caused by cooling of residual gases and the resulting underpressure in the combustion chamber, are known. The temperature of the wall of the combustion chamber, which is usually a cylindrical wall, can reach, with a high setting frequently and high outer temperature, close to 150°. Thereby cooling of the residual gases in the combustion chamber and the speed of return movement are reduced or at least somewhat slows.

The return movement of the piston depends on a temperature difference between the residual gas and the temperature of the combustion chamber or cylindrical wall. The smaller is the temperature difference the slower the residual gas cools, and more time is required for return of the piston to its initial rearward position. This, in turn, reduces the setting frequency. For an effective, more rapid setting process a high cooling-down rate is required for a more rapid return of the piston to its initial position and, thus, for a high setting frequency. Moreover, with a more rapid return of the piston to its initial position, leakage become less relevant than with a slower return of the piston to its initial position.

Accordingly, an object of the present invention is a power tool that would provide a high setting rate with a longer running time and/or high environmental temperatures.

Another object of the present invention is a method that would provide for a high setting rate of a setting tool with its longer running time and/or high environmental temperatures.

SUMMARY OF THE INVENTION

These and other objects of the present invention, which will become apparent hereinafter, are achieved by providing cooling means connected at least with a power tool combustion chamber for cooling the chamber wall with a liquid cooling medium. As a cooling medium, e.g., water can be used.

The present invention is based on an idea that a most possible high speed of the return movement of the piston only then can be achieved when the temperature difference between a relatively hot residual gas in the combustion chamber and the relatively colder combustion chamber wall is particularly high. With often-repeated setting processes at high outer or environmental temperatures, a temperature difference between the temperatures of the residual gas and the combustion chamber wall is reduced with an increase of the temperature of the chamber wall and can be reduced to such an extent that the underpressure in the combustion chamber and the guide cylinder is not any more sufficient to insure return of the piston to its initial position. The present invention solves the problem resulting from reduction of the temperature difference between the temperatures of the residual gases and the combustion chamber wall.

According to an advantageous embodiment of the present invention, the cooling means is at least partially integrated in the combustion chamber wall and, if necessary, in the wall of the guide cylinder, so that the cooling medium flows through the walls. This permits to keep the temperatures of the chamber wall and the guide cylinder wall relatively low despite the high frequency of the setting processes and, thereby, to insure a high temperature difference between the residual gas and the walls.

According to particular advantageous embodiment of the present invention, the cooling is achieved by evaporation of the liquid cooling medium in the cooling means. To this end, the cooling means is connected with a pressure control valve for removing the hot gaseous cooling medium from the cooling means through the valve. The replenishing of the liquid cooling medium is insured by provision of a cooling medium reservoir connected with the cooling means. With the cooling means being integrated in the combustion chamber wall, and if necessary, in the guide cylinder wall, the high temperature of the walls is transmitted to the cooling means, the liquid fluid medium that flow therethrough is evaporated, changing is condition from liquid to gaseous. The change of the condition of the cooling medium is accompanied by absorption of a large amount of heat which is removed from the walls. The gaseous cooling medium is released through the pressure control valve, which is connected with the cooling means, into the environment, removing the heat from the tool. The advantage of this consists in that with simple cooling means, an efficient cooling of the combustion chamber, i.e., of the wall that encloses the combustion chamber, becomes possible. Thereby, a constant, sufficiently large underpressure is created in the combustion chamber and the guide cylinder after the ignition and combustion of fuel, and a more rapid return of the piston to its initial position is achieved.

According to a further advantageous embodiment of the present invention, there is provided a sensor for measuring the temperature of the combustion chamber, and the cooling means, the pressure control valve, and the delivery of the cooling medium from the cooling medium reservoir can be controlled, separately or in combination, dependent on the measured temperature of the combustion chamber.

Further, according to the present invention, there is also provided a sensor for measuring the temperature of the cooling medium, and the cooling means, the pressure control valve, and the delivery of the cooling medium from the reservoir can be controlled, separately or in combination, dependent on the measured temperature of the cooling medium.

According to yet another embodiment of the present invention, the power tool includes a spray device associated with the combustion chamber. This spray device is so arranged that is capable of spraying at least the combustion chamber wall, from outside, with liquid cooling medium. It is particular advantageous when the spray device applies the cooling medium to the combustion chamber wall in form of droplets. By applying the cooling medium to the combustion chamber wall, the expenses associated with cooling are very low, as no seals, no pressure control valve, no cooling means, which is to-be-integrated in the combustion chamber wall, is required.

With this embodiment of the invention, no constructional modification of the combustion chamber is necessary. The only thing, which is necessary, is to place the spray device in the vicinity of the combustion chamber—limiting wall to insure a large surface-spraying of the wall, in particular, of the particularly hot sections of the wall. The spray device can also be used with power tools used in different positions.

Thus, the spray device can be manually actuated by a tool user so that the user actuates the spray device for cooling the combustion chamber when the outer or environmental temperature is high or when he/she feels that the tool temperatures is too high. The advantage of this consists in that the spray device is only then actuated when the user notices that the tool became heated or the piston returnmovement is too long.

According to an embodiment of the invention, the actuation of the spray device can be affected automatically for each setting process. The advantage of this consists in that the combustion chamber wall is regularly cooled by application of cooling medium and thereby is kept at a constant temperature, so that a constant underpressure is provided which makes possible to attain a constant speed of the return movement of the piston. To this end, the power tool is provided at its mouthpiece with a mechanism or an actuation device that at each application of the power tool against a surface, actuation of the spray device takes place.

Further, according to a modification of the power tool with a spray device, there is provided a sensor for sensing the temperature of the combustion chamber. The measured or sensed temperature is used for actuation of the spray device only then when the measured temperature exceeded a predetermined threshold. Thus, the spray device is actuated or is shut off only then when a certain threshold is exceeded. In this embodiment of the power tool, the spray device is controlled dependent only on the temperature of the combustion chamber. However, it is also possible to actuated the spray device dependent on both the temperature of the combustion chamber and application of the tool mouth section against a surface.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
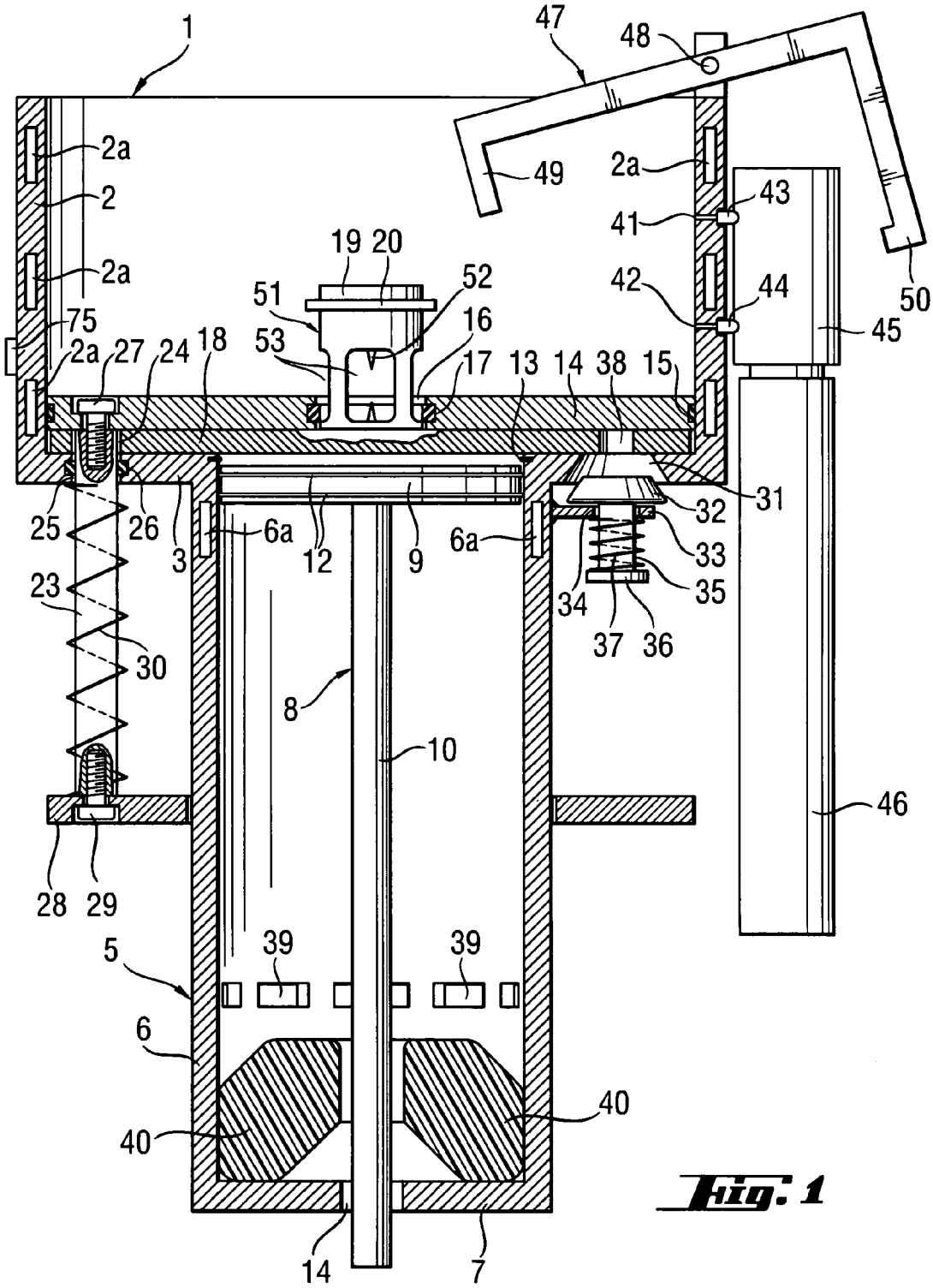
FIG. 1. an axial cross-sectional view of a combustion-engined tool with a collapsed combustion chamber which is cooled.

FIG. 1 shows an axial cross-sectional view of a combustion-engined setting tool according to the present invention in the region of its combustion chamber. The tool shown in FIG. 1 has a cylindrical combustion chamber having a cylindrical wall and an annular bottom wall 3 that adjoins the cylindrical wall 2. In the center of the bottom wall 3, there is provided an opening 4 which a guide cylinder 5 adjoins. The guide cylinder 5 has a cylindrical wall 6 and a bottom wall 7. A piston 8 is slidably displaced in the guide cylinder 5 in the longitudinal direction of the guide cylinder 5. The piston 8 is formed of a piston plate 9 facing the combustion chamber and a piston rod 10 which is secured to the piston plate 9 in its center. The piston rod 10 projects beyond a through-opening 11 which is formed in the bottom wall 7 of the guide cylinder 5.

In FIG. 1, the piston 8 occupies its rear, initial position in which the setting tool is not operated. The side of the piston plate 9 adjacent to the combustion chamber abuts the bottom wall 3 of the combustion chamber to greater or lesser extent and the free end of the piston rod 10 only slightly projects beyond the bottom wall 7 of the guide cylinder 5. For sealing the space on one side of the piston plate 9 from the space on the other side of the piston plate 9, sealing ring 12, 13 can be provided either on outer circumference of the piston plate 9 or on the inner circumference of the cylindrical wall 6 of the guide cylinder 5.

Within the combustion chamber 1, there is provided a cylindrical plate that will be referred to below as a displaceable wall 14. The displaceable wall 14 can be displaced in the longitudinal direction of the combustion chamber 1 and is provided on its outer circumference with an annular seal 15 for sealing chambers on opposite sides of the displaceable wall 14. The displaceable wall 14 has a central opening 16 provided with a circumferential seal 17.

Between the displaceable wall 14 and the bottom wall 3 of the combustion chamber 1, there is provided a separation plate 18 is that is also formed as cylindrical plate the outer diameter of which corresponds to the inner diameter of the combustion chamber 1. The side of the separation plate 18 adjacent to the displaceable wall 14 is connected with a headpiece 19 that projects through the opening 16 of the displaceable wall 14 and has a length exceeding the thickness of the displaceable wall 14 in several times. The circumferential seal 17 closely abuts the outer circumferential surface of the cylindrical headpiece 19. At its free end, the cylindrical headpiece 19 has a shoulder 20 that extends radially beyond the circumference of the headpiece 19. The outer diameter of the shoulder 20 is greater than the inner diameter of the opening 16. Thus, when the displaceable wall 14 is displaced away from the bottom wall 3 of the combustion chamber 1, after a predetermined time period, it engages the shoulder 20 and entrains the separation plate 18. The displaceable wall 14 and the separation plate 18 are spaced from each other, in the entraining position of the displaceable wall 14, by a distance corresponding to the length of the headpiece 19. The space between the displaceable wall 14 and the separation plate 18 forms a prechamber 21 that forms a portion of the combustion chamber 1, as is clearly seen in FIG. 2. When the displaceable plate 14 is lifted further, it is displaced together with the separation plate 18, with formation of another chamber between the separation plate 18 and the bottom plate 3 of the combustion chamber 1. This chamber forms a main chamber and is designated with a reference numeral 22. The main chamber 22 can also be seen in FIG. 2.

Figure 2:
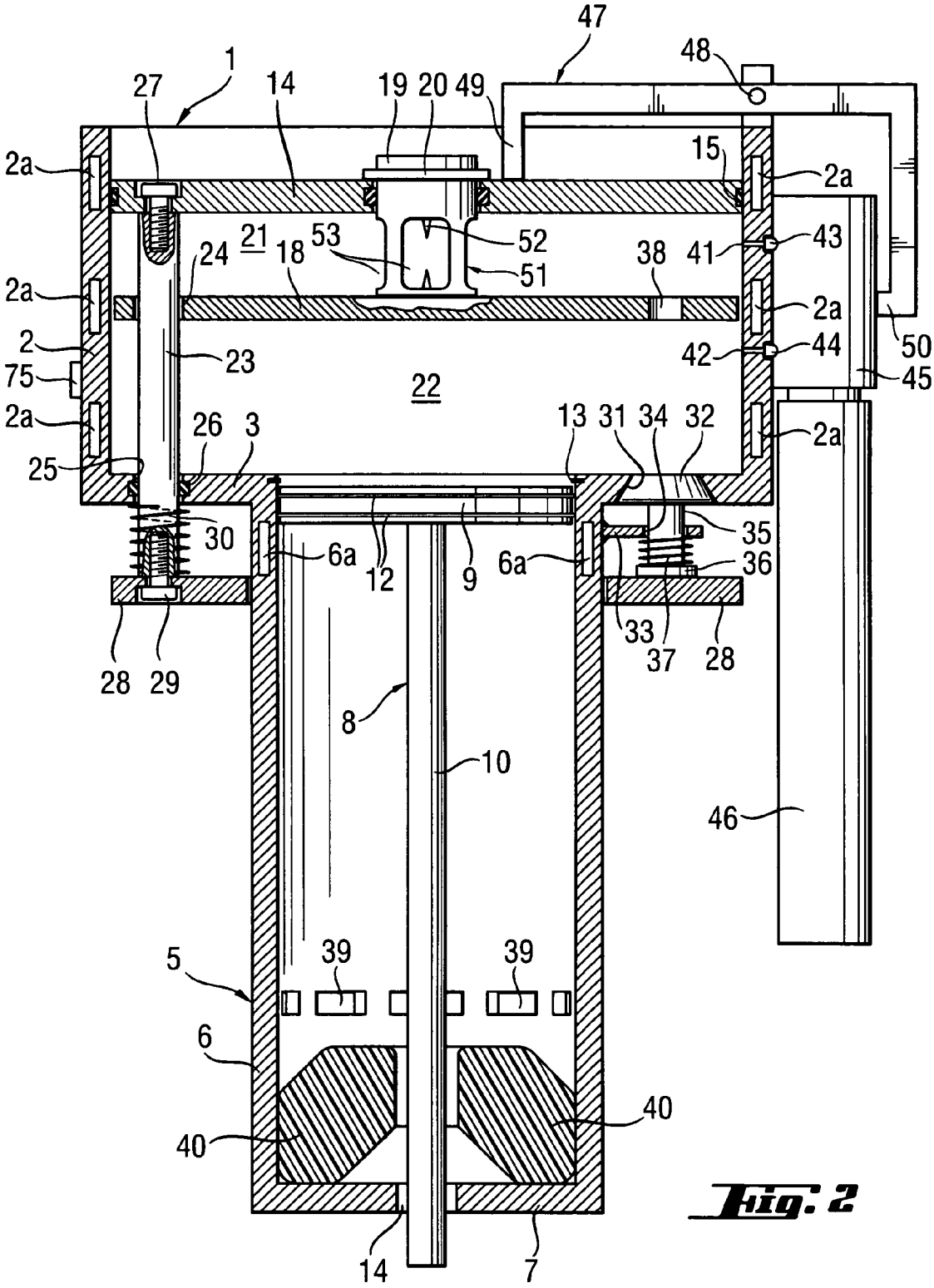
FIG. 2. an axial cross-sectional view similar to that of FIG. 1 but with the expanded combustion chamber.

For displacing the displaceable wall 14 in the longitudinal direction of the combustion chamber 1 in the embodiment of the tool shown in FIGS. 1–2, the drive rods 23 are uniformly distributed over its circumference and are fixedly connected thereto. The drive rods 23 extend parallel to a longitudinal axis of the combustion chamber 1 outside of the cylindrical wall 6 of the guide cylinder 5. The drive rods 23 extend through respective openings 24 formed in the separation plate 18 and through openings 25 formed in the bottom in wall 3 of the combustion chamber 1.

For sealing the space on opposite sides of the bottom wall 3, an inner circumferential seal 26 is provided in each of the openings 25. The displaceable wall 14 and- the drive rods 23 are connected with each other by screws 27 which extend through the displaceable plate 14 and are screwed in the drive rods 23 through their end surfaces. The drive rods 23 are connected with each other, at their free ends, with a drive ring 28. The drive ring 28 is connected with the drive rods 23 by screws 29 which extend through the drive ring 28 and are screwed into the drive rods 23 from the side opposite the side the screws 27, which connect the displaceable plate 14 with drive rods 23, are screwed in. A compression spring 30, which is supported against the bottom wall 3 and the drive ring 28, surrounds each of the drive rods 23. The compression springs 30 insure that the displaceable wall 14 is always biased toward the bottom wall 3 of the combustion chamber 1.

In the region of the bottom wall 3, there is provided a ventilation opening 31 into which a valve tappet 32 sealingly extends. When the ventilation opening 31 is open, the valve tappet 32 is located outside of the combustion chamber 1, e.g., beneath the bottom wall 3 and is supported against a shoulder 33 which is attached to the guide cylinder 5. The shoulder 33 has an opening 34 through which a cylindrical pin 35, which is secured to the bottom of the valve tappet 32, extends. At the free end of the pin 35, there is provided an annular shoulder 36. A compression spring 37 is arranged between the shoulder 36 and the shoulder 33 secured to the guide cylinder 5. The compression spring 37 pulls the valve tappet 32 via the shoulder 36 away from the bottom wall 3 in order to open the opening 31. The pin 35 lies in the displacement path of the drive ring 28 and is displaced thereby when the drive ring 28 is displaced toward the bottom wall 3. In a predetermined position of the drive ring 28, the valve tappet 32 is entrained thereby and closes the ventilation opening 31.

A plurality of openings 38 is provided in the separation plate 18 and which are circumferentially arranged about the axis of the combustion chamber 1 at the same distance therefrom. At the lower end of the guide cylinder 5, there is provided a plurality of openings 39 for venting air from the guide cylinder 5 when the piston 8 moves toward the bottom wall 7 of the guide cylinder 5. At the bottom end of the guide cylinder 5, there is arranged damping means 40 for damping the movement of the piston 8. When the piston 8 is displaced past the opening 39, the exhaust or waste gases can escape through the openings 39.

Two radial through-openings 41, 42 are formed in the cylindrical wall 2 of the combustion chamber 1 in a spaced relationship to each other. Into the radial through-openings 41, 42, outlet channels 43, 44 of metering valves (not shown in detail) extend from outside. The metering valves are located in the metering head 45. A liquefied fuel gas in delivered to the metering valves in the metering head 45 from a flask 46. The liquefied fuel gas is injected in a predetermined amount through the outlet channels 43, 44 when the metering head 45 is pressed against the cylindrical wall 2 of the combustion chamber 1, and the outlet channel 43, 44 extend into the radial through-opening 41, 42, opening respective metering valves. To this end, the radial through-openings 43, 44 taper in a direction toward the combustion chamber 1, providing stops for the outlet channels 43, 44. The pressing of the metering head 45 against the cylindrical wall 2 is effected with a stirrup 47 which is pivotally supported by a pivot 48 of the cylindrical wall 2. When the displacement plate 14 impacts the end 49 of the stirrup 47, the stirrup 47 pivots, and the opposite stirrup end 50 pushes the metering head 45 toward the cylindrical wall 2. This process takes place shortly before the displaceable wall 14 reaches, during the expansion of the combustion chamber 1, its end position. The metering head 45 and the flask 46 are assembled only once, and then they remain connected. The system metering head/flask 45/46 can pivot about an axle provided in the bottom region of the flask 46.

FIG. 2 shows the inventive setting tool with an expanded combustion chamber 1, with expanded prechamber 21 and main chamber 22. The displacement positions of the displaceable wall 14 and the separation plate 18 are achieved when the drive ring 28 impacts the shoulder 36, closing the ventilation opening 31 with the valve tappet 32. The circumferential surfaces of the opening 31 and the valve tappet 32 are formed as conical surfaces tapering toward the combustion chamber 1. As it has already been mentioned previously, the displaceable wall 14 and the separation plate 18 are spaced by a distance corresponding to the length of the headpiece 19 or the distance between the shoulder 20 and the separation plate 18. In this position of the displaceable wall 14 and the separation plate 18, the radial through-openings 41, 42 are located against the prechamber 21 and the main chamber 22.

The headpiece 19, which is connected with the separation plate 18, has its end portion adjacent to the separation plate 18 formed as an ignition cage 51 for receiving an ignition device 52. The ignition device 52 is used for generating sparks for ignition of an air-fuel gas mixture in the prechamber 21. As it would be described in more detail below, the ignition device 52 is located in the inner or central region of the cage 51 provided with a plurality of circumferential openings 53 through which a laminate flame front exits from the cage 51 into the prechamber 21.

Below, the operation of the setting tool will be described with reference to FIGS. 1–2.

FIG. 1 shows the setting tool in its non-operative position. The combustion chamber 1 is completely collapsed, with the separation plate 18 lying on the bottom wall 3 and the displaceable wall 14 lying on the separation plate 18. The piston 8 is in its rear initial position, with practically no space between the piston 8 and the separation plate 18, if one would disregard a small gap there between. The lying one above the other, displacement plate 14 and the separation plate 18 are brought to the position by the compression springs 30 which push the drive ring 28 in a direction away from the bottom wall 3, with the drive ring 28 pulling, with the drive rods 23, the displaceable wall 14 and the separation plate 18 toward each other and toward the bottom wall 3. In this position of the drive ring 28, it is spaced from the shoulder 36 of the valve tappet 32, and the valve tappet 32 is kept away from the ventilation opening 31 by the compression spring 37, with the opening 31 being open. The system metering head 45/flask 46 is pivoted away from the combustion chamber 1, with the outlet channels 43, 44 being released and the respective metering valves being thereby closed.

When in this condition of the setting tool, it is pressed with a forward piece against an object or any other surface, into which a fastening element is to be driven in, the press-on force acts, via a corresponding mechanism, on the drive ring 28, pushing it toward the bottom wall 3, simultaneously with pushing the setting tool against the object. First, the displaceable wall 14 is pulled away from the separation plate 18 until the displaceable wall 14 abuts the shoulder 20, and the prechamber 21 is formed but it does not occupy its right position in the combustion chamber 1. During the expansion of the prechamber 21, air can be aspirated thereinto. The air is aspirated first through the ventilation opening 31 and then through an opening 38 that overlaps the opening 31.

As the setting tool is being pressed further against the object, the drive ring 28 moves further toward the bottom wall 3, and the displaceable wall 14, which is being moved further, lifts the separation plate 18 off the bottom wall 3.

As soon as the displaceable wall 14 and the separation plate 18 pass past the respective opening 41, 42, the injection of a metered amount of fuel into the prechamber 21 and the main chamber 22 can take place. To this end, the displaceable wall 14 strikes the end 49 of the stirrup 47, pivoting the stirrup 47 clockwise about the pivot 48, and the other end 50 pushes the metering head 45 toward the combustion chamber 1, and the fuel gas is injected into the prechamber 21 and the main chamber 22. The displaceable wall 14 and the separation plate 18 are lifted somewhat more to their end positions, in which they are locked. The accompanied pivoted movement of the stirrup 47 is compensated by a further displacement of the channels 43, 44 further into the metering head 45.

At the last stage of the displaceable wall 14 and the separation plate 18, the valve tappet 32 is inserted into the opening 31, closing the same as a result of the drive ring 28 engaging the shoulder 36.

FIG. 2 show the positions of the displaceable wall 14 and the separation plate 18 in which the prechamber 21 and the main chamber 22 are completely expanded and in which the they can now be locked. The locking is effected by actuation of an actuation lever or trigger of the setting tool (not shown). Upon actuation of the lever or trigger, the locking of the displaceable wall 14 and the separation plate 18 takes place. The locking is effected by locking the drive ring 28. Shortly after the locking of the displaceable wall 14 and the separation plate 18, with the ignition device 52 which is located in the ignition cage 51, an electrical spark is produced. First, the air-fuel gas mixture in the prechamber 21 is ignited and is combusted in a laminar manner. The flame front spreads with a relatively low velocity radially toward the openings 38 in the separation plate 18, displacing the non-combusted, air-fuel gas mixture in front of it. The non-combusted air-fuel gas mixture flows through the openings 38 into the main chamber 22, creating there turbulence and precompression. When the flame front reaches the openings 38, it enters, because of a small cross-sections of the openings 38, in form of flame jets into the main chamber 22 through the opening 38, creating there a further turbulence. The turbulent air-fuel gas mixture in the main chamber 22 is ignited over the entire surface of the flame jets. It is combusted with high speed, which noticeable increases the effectiveness of combustion.

The expanded combustion gases impact the piston 8 which moves in a direction toward the bottom wall 7 of the guide cylinder 5 with high speed with the air being forced out through the openings 39 into atmosphere. When the piston plate 9 passes the openings 39, the exhaust gases can also escape there-through. A fastening element is set with the projecting piston rod 10. After the fastening element has been set or upon completion of combustion of the air-fuel gas/mixture, the piston 8 is brought into its initial position by thermal restoration which results from cooling of fuel or residual gases in the combustion chamber 1 and the guide cylinder 5, which cooling produces under-pressure behind the piston 8. The combustion chamber 1 remains sealingly closed until the piston 8 returns to its initial position shown in FIG. 2.

When it is ascertained that the piston 8 has reached its initial position in FIG. 2, the locking of the displaceable wall 14 or of the drive ring 28 is released. The compression springs 30 push the drive ring 28 away from the bottom wall 3. The drive ring 28 releases the shoulder 36 of the valve tappet 32, and the spring 37 pulls the valve tappet 32 out of the ventilation opening 31, opening the opening 31. As the drive ring 28 is displaced further away from the bottom wall 3, it pulls the displaceable wall 14 toward the bottom wall 3. Upon being pulled, the displaceable wall 14 entrains the separation plate 18 with it when it abuts the same. When the displaceable wall 14 is displaced toward the separation plate 18, it forces waste gases from prechamber 21 through the openings 38 into the main chamber 22, with the waste gases in the main chamber 22 being forced out through the ventilation opening 31. Finally, the separation plate 18 abuts the bottom wall 3, with the displaceable wall 14 lying on the separation plate 18. The combustion chamber 1 has completely collapsed and freed from the waste gases, and the aeration process, which was described with reference to FIG. 1, can start anew upon a following initiation of a setting process.

In order to bring the piston 8 in its initial position in FIG. 2 by the thermal restoration, according to the invention, care is being taken that the temperature difference between the relatively hot residual gas in the combustion chamber 1, on one hand, and the cylindrical wall 2 of the combustion chamber 1 and the upper portion of the cylindrical wall 6 of the guide cylinder 5, on the other hand, remains relatively large. To this end, the cylindrical wall 2 of the combustion chamber 1 and the upper portion of the cylindrical wall 6 of the guide cylinder 5 are cooled. To this end, in the cylindrical wall 2 and the cylindrical wall 6, circumferential annular channels 2*a* and 6*a*, respectively, which are connected with each other are formed, and a cooling medium is flown therethrough. The cooling medium evaporates upon contact with walls 2 and 6. As cooling medium, e.g., water can be used, the condition of which changes from liquid to gaseous upon evaporation. The evaporation of the cooling medium results in removal of a substantial amount of heat from the cylindrical walls 2 and 6, which permits them to keep their temperature at a relatively low level. The evaporated cooling medium is released into atmosphere through a pressure control valve 62 (see FIG. 3). The cooling medium flows into the cooling channels 2*a*, 6*a* from a cooling medium reservoir 61 (see FIG. 3). The connection of the cooling channels 2*a* and 6*a* with the reservoir 61 and the pressure control valve 62 is effected in accordance with the basic circuit that would be described below with reference to FIG. 3.

Figure 3:
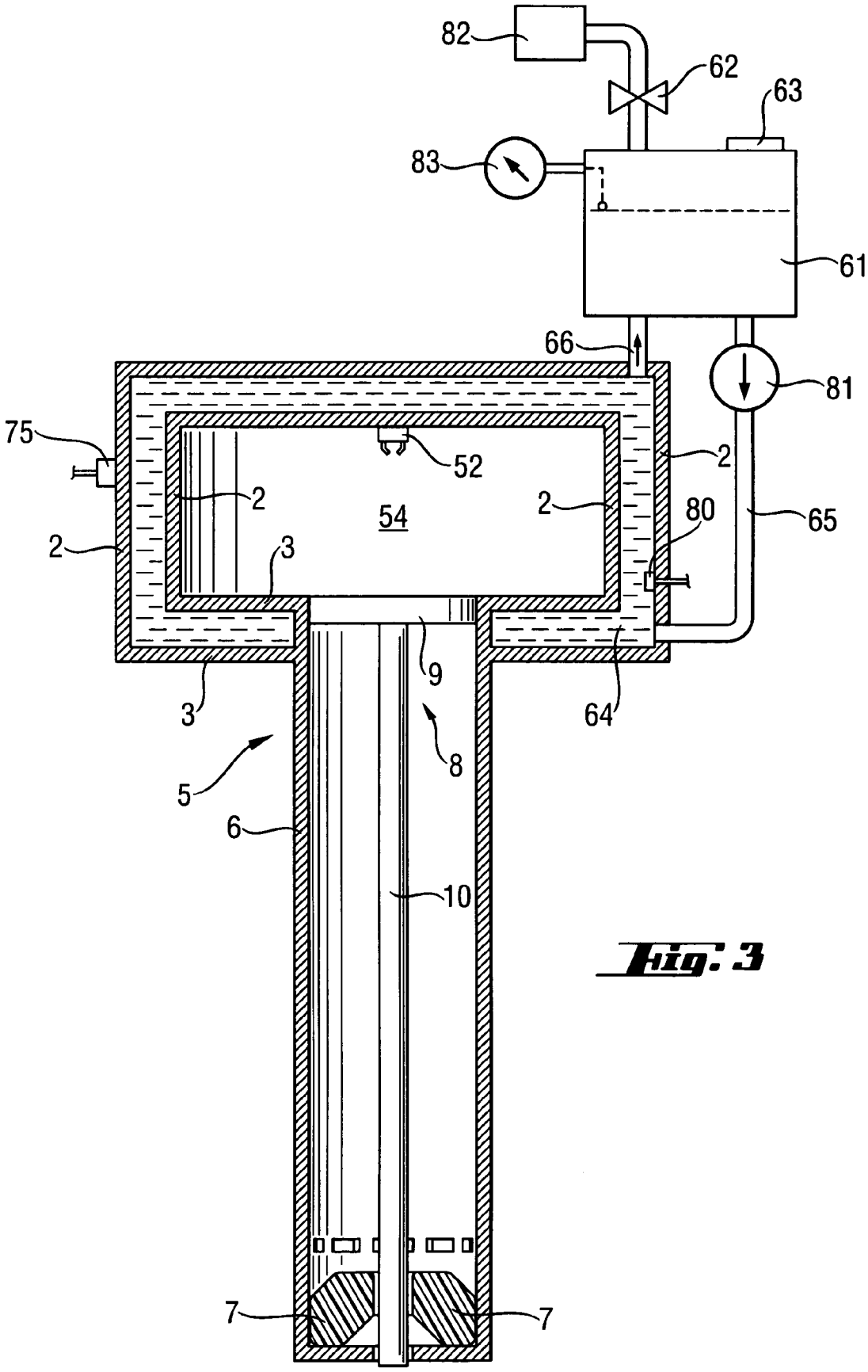
FIG. 3. an axial cross-sectional view of the combustion chamber and an integrated cooling device.

FIG. 3 shows the basic cooling circuit according to the present invention in connection with a combustion-engined tool different from that described with reference to FIGS. 1–2.

In the tool shown in FIG. 3, the cooling device 64 is integrated in walls 2, 3 of the combustion chamber 54. The cooling device 64 surrounds the combustion chamber 54 and the uppermost portion of the drive cylinder 5 in which the piston 8 is displaceable. The cooling device 64 is connected with a pressure control valve 62 and with a cooling medium reservoir 61. The cooling medium reservoir 61 has a replenishing nipple or connection 63 for filling the cooling device 64 with the cooling medium. This embodiment of a combustion-engined tool is particularly suitable for use as a nail driver which is used for driving nails in a preferable direction, e.g., as a floor-mounted driver. In this embodiment of a combustion-engined tool, the cooling medium flows around the entire combustion chamber 54 and the uppermost portion of the guide cylinder 5. The cooling device 64 is formed as a closed pressure system. Upon ignition of the fuel mixture, the combustion chamber 54 and the guide cylinder 5 are heated, the cooling medium evaporates and is released through the pressure control valve 62. With continuous replenishing of the cold liquid cooling medium from the reservoir 61, the equilibrium is maintained so that the maximum temperature of the cooling medium and, thereby, of the combustion chamber 54 and the guide cylinder 5 is limited to a predetermined temperature. This provides for a uniform cooling of the walls of the combustion chamber 54 and the guide cylinder 5, which, in turn, insures a stationary operational condition of the tool and which insures obtaining of a constant underpressure necessary for a quick return of the piston to its initial position.

With measurement of the temperature of the combustion chamber wall with a first temperature sensor 75 and measurement of the temperature of the cooling medium with a second temperature sensor 80, the cooling device 64, the pressure control valve 62, and the reservoir 61 can be controlled dependent on the temperature of the combustion chamber 54 and/or the temperature of the cooling medium separately or in combination.

By an appropriate construction of the cooling device, e.g., using a cooling medium with a corresponding evaporation temperature, and with a corresponding proximity of the cooling device to the combustion chamber 54, it is insured that the cooling medium evaporates upon heating of the combustion chamber 54, with the heat of the evaporation being released through the pressure control valve 62, which insures a rapid heat exchange.

For optimal cooling, the cooling device 64 is connected with a circulation device 81, which together with conduits 65, 66, insures a uniform circulation of the cooling medium in the cooling device 64.

The pressure control valve 62 is provided with a liquid collector 63 for collecting the evaporated cooling medium.

The reservoir 61 is provided with a liquid indicator 83 for monitoring the liquid in the reservoir.

According to a further embodiment, the reservoir 61 is connected with a switch that disconnects the tool from the reservoir when the amount of cooling medium thereby is below a predetermined threshold.

Figure 4:
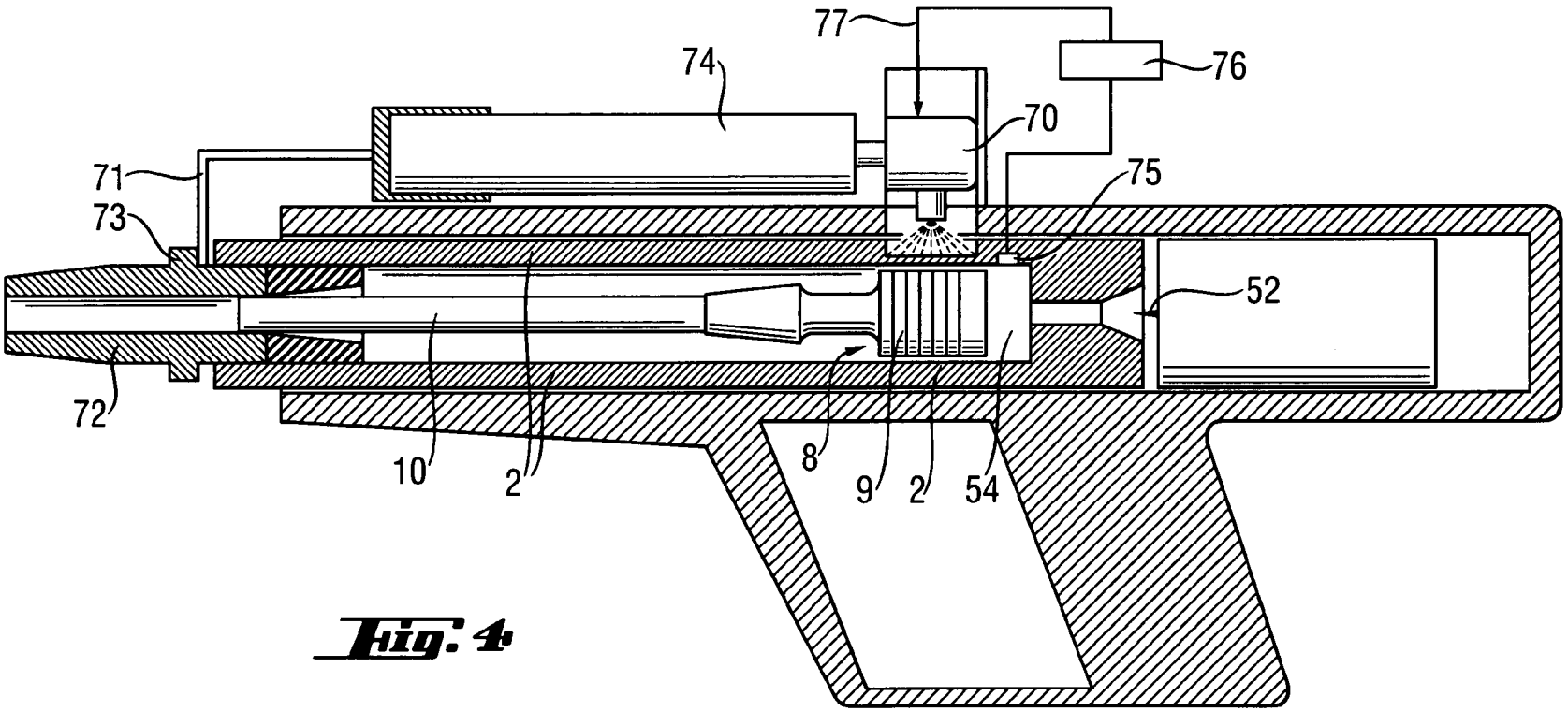
FIG. 4. a cross-sectional view of a power charge-operated tool with a spray device.

FIG. 4 shows a power charge-operated tool with a spray device 70 that sprays the wall 2 of the combustion chamber 54 in the region of the piston head 9, when the piston 8 is in its initial position. The wall 2 is sprayed with droplets of the cooling medium. An actuation device 71 actuates the spray device 70 each time the tool is pressed against a constructional component, with a shoulder 73 of the tool mouth piece 72 actuating the actuation device 71. The actuation device 71 displaces the spray medium reservoir 74 toward the spray device 70, whereby the valve of the reservoir 74 opens, with spray medium droplets being ejected from the spray device 70. In addition or alternatively, a temperature sensor 75 is arranged on the combustion chamber wall 2. Thus, the spray device 70 can be actuated when the temperature of the combustion chamber wall 2 exceeds a predetermined threshold.

Likewise, the spray process can be initiated when both the tool is pressed against a constructional component (or is actuated) and the temperature of the combustion chamber wall exceeds a predetermined threshold.

The temperature of the wall 2 of the combustion chamber 54 in the region of the initial position of the piston head 9 is sensed by the sensor 75 and is communicated to a temperature comparator 76, where it is compared with a preset temperature. When the measured temperature exceeds the preset temperature, an electrical actuation signal is transmitted to the spray device 70 via a conductor 77. I.e., the spraying takes place only when the preset temperature is exceeded, with the setting tool being pressed against a constructional component with the tool mouthpiece 72 and with the shoulder 73 of the mouthpiece 72 actuating the actuation device 71.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A combustion-engined power tool, comprising a combustion chamber (1; 54); a cylinder (5) adjoining the combustion chamber (1; 54); a drive piston (8) displaceable in the cylinder (5) upon combustion of fuel in the combustion chamber; an ignition device (52) for igniting the fuel in the combustion chamber (1; 54) and cooling means (2*a*, 6*a*; 64) at least partially integrated in a wall (2) of the combustion chamber (1; 54) for reducing temperature in the combustion chamber (5) by evaporation of a liquid cooling medium in the cooling means for creating under pressure therein to facilitate a return movement of the drive piston (8) in an initial position thereof.

2. A power tool according to claim 1, wherein the combustion chamber (1; 54) is cooled by evaporation of cooling medium in the cooling means (2*a*, 6*a*, 64).

3. A power tool according to claim 2, further comprising a pressure control valve (62) for removing an evaporated cooling medium, and a cooling medium reservoir for replenishing the liquid cooling medium in the cooling means (2*a*, 6*a*; 64).

4. A power tool according to claim 3, further comprising a first sensor (75) for measuring a temperature of the combustion chamber (54) and for generating a control signal for controlling the pressure control valve (62).

5. A power tool according to claim 3, further comprising a sensor (80) for measuring a temperature of the cooling medium (54) and for generating a control signal for controlling the pressure control valve (62).

6. A power tool according to claim 1, further comprising a guide cylinder (5) adjoining the combustion chamber (1; 54) and in which the piston (8) is displaceable, wherein the guide cylinder (5) is also connected with the cooling means (2*a*, 6*a*; 64) for being cooled, at least partially.

7. A power tool according to claim 1, wherein the cooling means (70) is formed as a spray device for spraying the liquid cooling medium onto a wall (2) of the combustion chamber (54).

8. A power tool according to claim 7, wherein the spray device (70) is actuated when the tool is pressed, with a mouthpiece thereof, against an object.

9. A power tool according to claim 7, further comprising a sensor (75) for measuring temperature of the combustion chamber (54) and for generating a control signal for controlling the spray device (70).

10. A method of cooling a combustion-engined power tool having a combustion chamber (1; 54), a cylinder (5) adjoining the combustion chamber (1; 54); a drive piston (8) displaceable in the cylinder (5) upon combustion of fuel in the combustion chamber; and an ignition device (52) for igniting fuel in the combustion chamber, the method comprising the steps of integrating, at least partially, cooling means in a wall (2) of the combustion chamber (1; 54); and delivering a liquid cooling medium to cooling means **(2*a*, 6*a*; 64) integrated in a wall (2) of the combustion chamber (1; 54) for cooling the combustion chamber (1; 54) by evaporation of the liquid cooling medium in the cooling means (2*a*, 6*a*; 64), and removing evaporated cooling medium through a pressure control valve (62) connected with the cooling means (64), whereby temperature in the combustion chamber (5) is reduced for creating underpressure therein so that a return movement of the drive piston (8)** in an initial position thereof is facilitated.

11. A method according to claim 10, comprising the step of controlling the pressure control valve (62) dependent on at least one of a temperature of the combustion chamber and a temperature of the liquid cooling medium.

12. A method according to claim 10, comprising the step of providing a spray device (70) for applying the cooling medium to a wall (2) of the combustion chamber (54).

13. A method according to claim 12, wherein the spray device is actuated when the tool is pressed, with its mouthpiece, against an object.

14. A method according to claim 12, comprising the step of effecting one of actuation and release of the spray device (70) dependent on a temperature of the combustion chamber (54).

* * * * *